US010203096B2

(12) United States Patent
Groenke

(10) Patent No.: US 10,203,096 B2
(45) Date of Patent: Feb. 12, 2019

(54) POWERING AND FASTENING A LIGHT EMITTING DIODE OR CHIP-ON-BOARD COMPONENT TO A HEATSINK

(71) Applicant: Conservation Technology of Illinois LLC, Northbrook, IL (US)

(72) Inventor: Mark Groenke, Grayslake, IL (US)

(73) Assignee: Conservation Technology of Illinois LLC, Northbrook, IL (US)

( * ) Notice: Subject to any disclaimer, the term of this patent is extended or adjusted under 35 U.S.C. 154(b) by 0 days.

(21) Appl. No.: 15/636,195

(22) Filed: Jun. 28, 2017

(65) Prior Publication Data

US 2019/0003690 A1 Jan. 3, 2019

(51) Int. Cl.

| | |
|---|---|
| ***F21V 29/00*** | (2015.01) |
| ***H01R 12/70*** | (2011.01) |
| ***F21V 19/00*** | (2006.01) |
| ***F21V 29/70*** | (2015.01) |
| ***H05B 33/06*** | (2006.01) |
| ***F21V 29/503*** | (2015.01) |

(Continued)

(52) U.S. Cl.

CPC ..... *F21V 19/0055* (2013.01); *F21V 29/503* (2015.01); *F21V 29/70* (2015.01); *H05B 33/06* (2013.01); *F21Y 2105/18* (2016.08); *F21Y 2115/10* (2016.08)

(58) Field of Classification Search

CPC .... F21V 19/0055; F21V 29/70; F21V 29/503; H05B 33/06; F21Y 2105/18; F21Y 2115/10

See application file for complete search history.

(56) References Cited

U.S. PATENT DOCUMENTS 8,596,837 B1 12/2013 Wronski
9,091,422 B2 * 7/2015 Greenfield ..... F21V 3/00

(Continued)

FOREIGN PATENT DOCUMENTS

CN 102853301 B 7/2014
JP 2013-109883 6/2013

(Continued)

OTHER PUBLICATIONS

UK Intellectual Propert Office, Patents Act 1977: Search Report under Section 17(5), dated Nov. 13, 2018 for GB1810091.7.

*Primary Examiner* — Tracie Y Green

(74) *Attorney, Agent, or Firm* — Leviton Manufacturing Co., Inc.

(57) ABSTRACT

A light emitting diode (LED) or chip-on-board (COB) assembly is disclosed. The assembly may include an LED or COB component, an electrical terminal, and a fastener. The LED or COB component may include an electrical pad, and the electrical terminal may be in at least partial contact with the electrical pad. The electrical terminal may be configured to electrically connect the LED or COB component to a power source. The fastener may be configured to mechanically attach the LED or COB component to a heatsink and maintain the contact of the electrical terminal to the electrical pad for the electrical connection to the power source. In some exemplary embodiments, the assembly may also include a bushing to insulate the fastener from the electrical terminal. In some exemplary embodiments, the assembly may also include a washer that may be positioned underneath the fastener.

20 Claims, 16 Drawing Sheets

(51) Int. Cl.
*F21Y 115/10* (2016.01)
*F21Y 105/18* (2016.01)

(56) References Cited

U.S. PATENT DOCUMENTS

| | | | | |
|---|---|---|---|---|
| 9,316,382 | B2 | 4/2016 | Rowlette | |
| 9,366,422 | B2 | 6/2016 | McClure et al. | |
| 2005/0134254 | A1 | 6/2005 | Roden | |
| 2007/0236935 | A1 | 10/2007 | Wang | |
| 2008/0099775 | A1* | 5/2008 | Yu | F21S 2/005 257/98 |
| 2010/0053962 | A1* | 3/2010 | Mo | F21V 21/002 362/249.01 |
| 2011/0063842 | A1 | 3/2011 | Takei | |
| 2012/0014108 | A1* | 1/2012 | Greenfield | F21V 3/00 362/294 |
| 2012/0294017 | A1* | 11/2012 | Nagasaki | H01R 12/515 362/382 |
| 2013/0258669 | A1* | 10/2013 | Qin | F21K 9/00 362/249.02 |
| 2014/0226334 | A1 | 8/2014 | Wan | |
| 2015/0034979 | A1* | 2/2015 | Lee | H01L 25/0753 257/89 |
| 2015/0055356 | A1 | 2/2015 | Derks et al. | |
| 2015/0117033 | A1 | 4/2015 | Chiu et al. | |
| 2016/0037591 | A1* | 2/2016 | Brown, Jr. | H05B 33/06 315/185 R |

FOREIGN PATENT DOCUMENTS

| | | | |
|---|---|---|---|
| WO | 2011043441 | A1 | 4/2011 |
| WO | 2014036579 | A1 | 3/2014 |

* cited by examiner

POWERING AND FASTENING A LIGHT EMITTING DIODE OR CHIP-ON-BOARD COMPONENT TO A HEATSINK

FIELD OF THE DISCLOSURE

The present disclosure relates generally to a light emitting diode (LED) or chip-on-board (COB) component, and more particularly, relates to powering the LED or COB component and mechanically attaching the component to a heatsink.

DESCRIPTION OF THE RELATED ART

LED or COB components used in lighting fixtures may be mechanically attached to a heatsink to prevent overheating, and electrically connected to a power source or an electrical driver. Typically, the LED or COB component may include a mounting hole or a cut out (also known as a "mouse bite") to mechanically attach the LED or COB component to the heatsink using a fastener. In addition, the LED or COB component may include an electrical pad at another position on the LED or COB component to solder electrical wires and electrically connect the LED or COB component to a power source or an electrical driver. With this arrangement, the mechanical attachment of the LED or COB component to the heatsink is separate from the electrical connection to the power source.

However, there are disadvantages to the prior art mechanical attachment and electrical connection of LED or COB components. For example, soldering electrical wires to the LED or COB component is a permanent connection, that may make replacement and servicing of the LED or COB component difficult. In addition, the act of soldering may overheat the LED or COB component thereby damaging or reducing the usable life of the LED or COB component. In addition, if the solder does not get hot enough during assembly, a brittle solder joint may be created, and the connection will eventually crack or electrically fail. While preheating the LED or COB component before soldering may prevent cold solder joints, it also increases manufacturing labor and costs.

In some light fixtures, LED holders are used to mechanically attach and electrically connect the LED or COB component. The LED holder overlaps the LED or COB component, positioning the mounting hole on the LED holder (instead of the LED or COB component) for mechanical attachment to the heatsink. When the LED holder is mechanically attached to the heatsink using the mounting hole on the LED holder, the LED holder pushes the LED or COB component against the heatsink. LED holders may also provide an electrical connection to a power source or electrical driver by spring-loaded contacts on the LED holder or by finger-like wire traps which contact the electrical pad on the LED or COB component.

However, there are disadvantages to using LED holders. For example, an LED holder increases the cost of making the fixture, and increases the overall size, as the LED holder typically overlaps the LED or COB component to increase the mounting space. An LED holder also makes using an optic in the fixture more difficult because ideally the optic needs to be in close proximity to the LED or COB component to maximize the amount of light and to create an efficient fixture; and, the overlap and thickness of the LED holder prevents close positioning of the optic to the LED or COB component. An LED holder also makes for complex assembly because the LED or COB component must be assembled to the LED holder before being mounted to the heatsink, and the LED holder is spring-loaded to push the LED or COB component away. Furthermore, LED holders may decrease the reliability of the electrical connection because the spring force of the spring-loaded contacts decreases over time. In addition, some LED holders do not use materials that prevent the electrical connection from corroding, which increases the electrical resistance of the connection and can result in an electrical short, overheating or fire. Servicing the LED or COB component becomes more difficult with LED holders as well because the LED holder has to be completely removed from the heatsink before the LED or COB component can be removed and replaced. This disassembly increases the risk of damaging the LED or COB component or the contacts on the LED holder.

SUMMARY OF THE DISCLOSURE

An LED assembly for attaching to a heatsink and electrically connecting to a power source is disclosed. The LED assembly preferably includes an LED component having at least one electrical pad, and at least one electrical terminal at least partially in contact with a corresponding one of the electrical pads. The electrical terminal is adapted and configured to electrically connect the LED component to the power source. In addition, the LED assembly preferably includes a fastener arranged and configured to maintain the contact of at least one of the electrical terminals to a corresponding one of the electrical pads and mechanically attach the LED component to the heatsink.

A method for assembling an LED assembly to a heatsink is also disclosed. The method preferably includes the steps of positioning at least one electrical pad on a surface of an LED component, and contacting at least one electrical terminal with a corresponding one of the electrical pads. In addition, the method preferably includes the step of mechanically attaching the LED component to the heatsink and maintaining the contact between at least one of the electrical terminals and a corresponding one of the electrical pads using a fastener so that the LED component is electrically connected to the power source.

A second, alternate embodiment of an LED assembly for attaching to a heatsink and electrically connecting to a power source is also disclosed. The LED assembly preferably includes an LED component having at least one electrical pad and a cut out formed therethrough. In addition, the LED assembly preferably includes at least one electrical terminal at least partially in contact with a corresponding one of the electrical pads. In use, the electrical terminal is arranged and configured to electrically connect the LED component to the power source. The LED assembly also preferably includes a fastener arranged and configured to maintain the contact of at least one of the electrical terminals to a corresponding one of the electrical pads and mechanically attach the LED component and the electrical terminal to the heatsink.

BRIEF DESCRIPTION OF THE DRAWING(S)

One or more aspects of the disclosed subject matter are particularly pointed out and distinctly claimed as examples in the claims at the conclusion of the specification. The foregoing and other objects, features, and advantages of the disclosed subject matter may be more readily understood by one skilled in the art with reference being had to the following detailed description of several embodiments thereof, taken in conjunction with the accompanying drawings wherein like elements are designated by identical reference numerals throughout the several views, and in which:

DETAILED DESCRIPTION

The present disclosure describes a system and method for powering an LED or COB component and mechanically attaching the LED or COB component to a heatsink. Embodiments will be described below while referencing the accompanying figures. The accompanying figures are merely examples and are not intended to limit the scope of the present disclosure.

Figure 1:
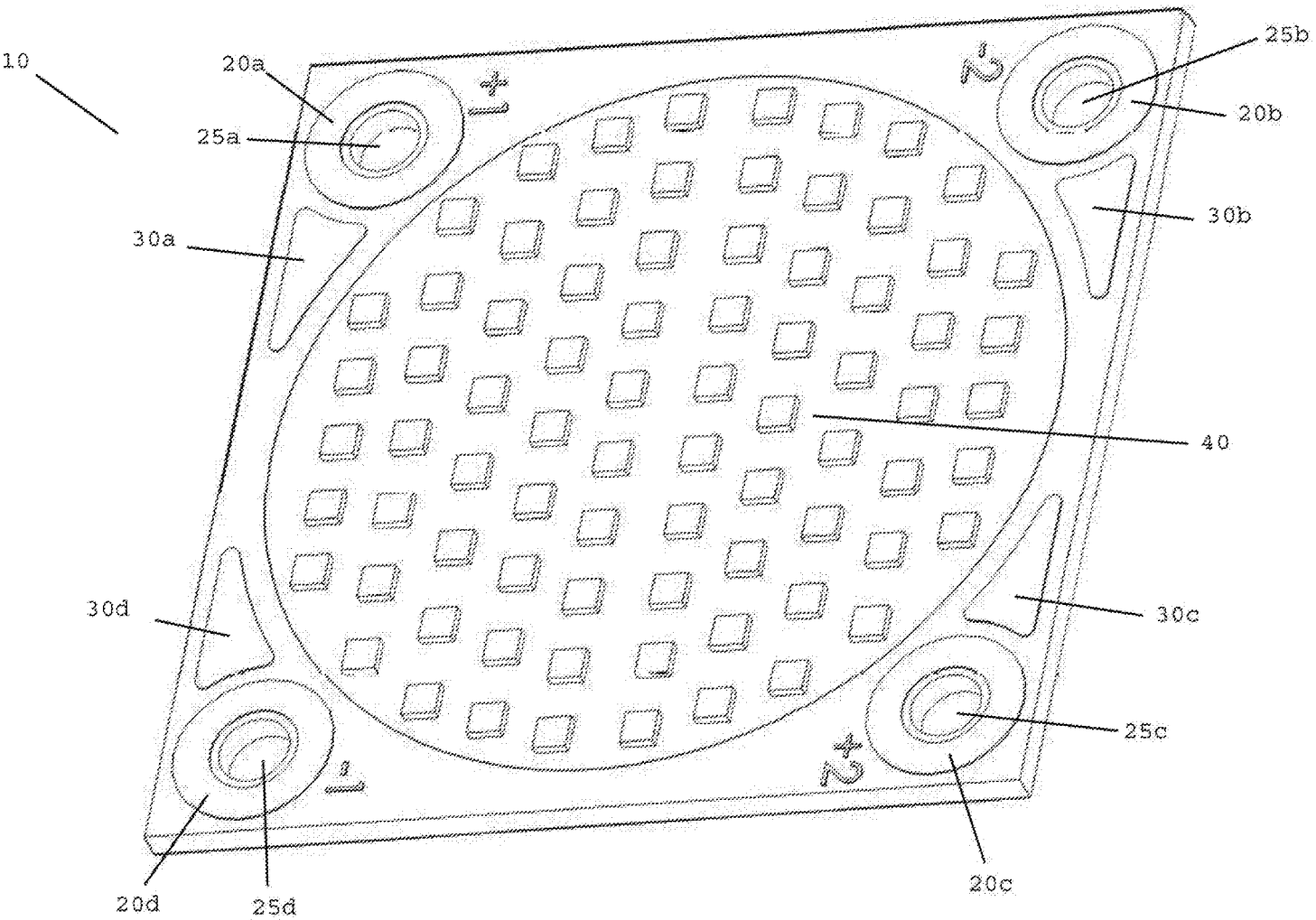
FIG. 1 is a perspective view of an exemplary embodiment of an LED component.

FIG. 1 illustrates an exemplary embodiment of an LED component 10. As shown, the LED component 10 may include a plurality of apertures 25*a-d* formed therethrough and an LED array 40. In addition, the LED component 10 may include a first plurality of electrical pads 20*a-d* and a second plurality of electrical pads 30*a-d*. The first plurality of electrical pads 20*a-d* at least partially surround the plurality of apertures 25*a-d*, respectively. In a preferable embodiment, the first plurality of electrical pads 20*a-d* are centered about the plurality of apertures 25*a-d*, respectively.

In this exemplary embodiment, the LED component 10 is a two-circuit LED array in which two separate power supplies are connected to the LED component 10. The side of the LED component 10 having +1 and −1 indications is powered by a first circuit, and the side of the LED component 10 having +2 and −2 indications is powered by a second circuit.

Figure 2:
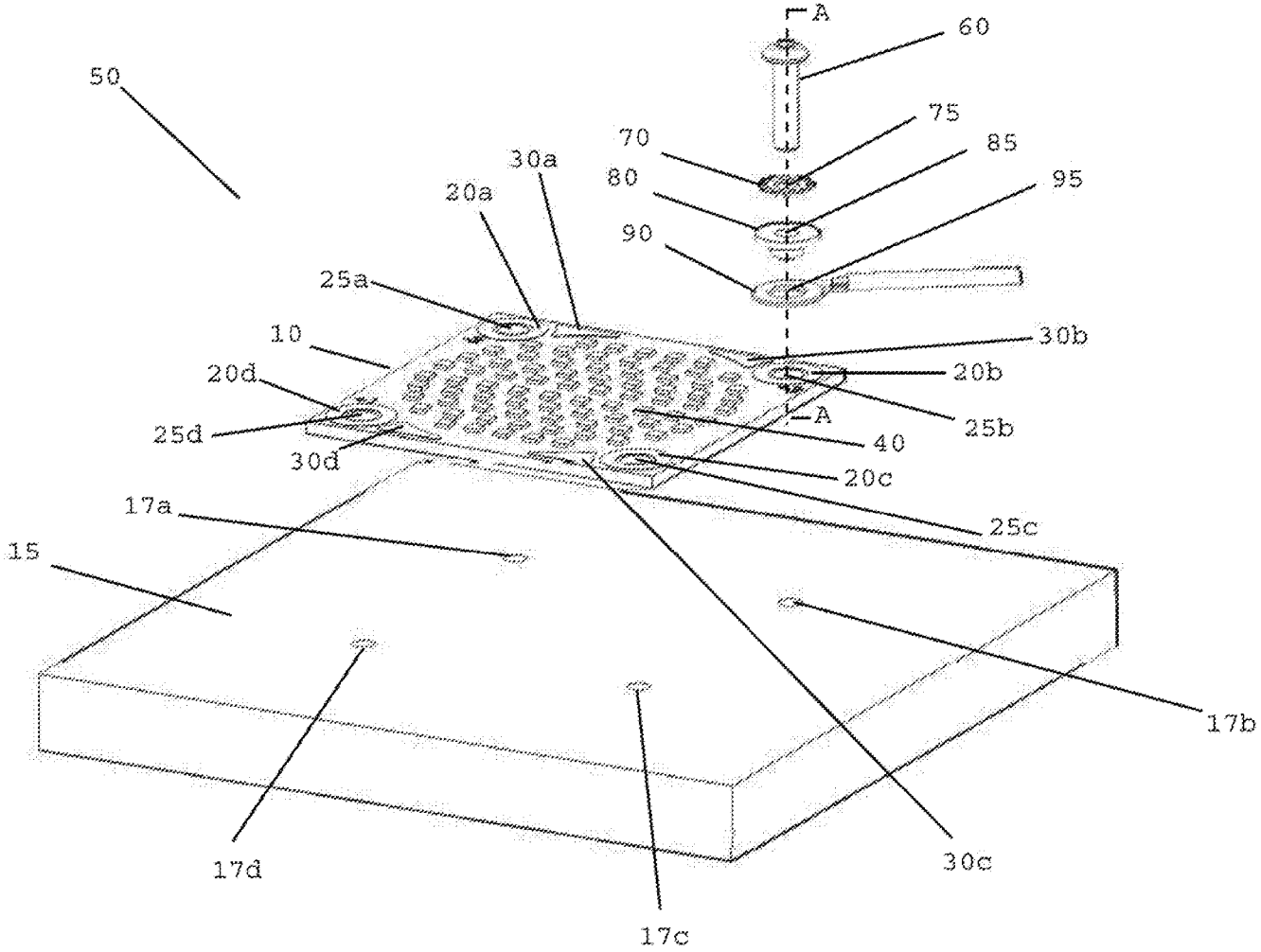
FIG. 2 is an exploded view of an exemplary embodiment of an LED assembly including the LED component of FIG. 1.
Figure 3A:
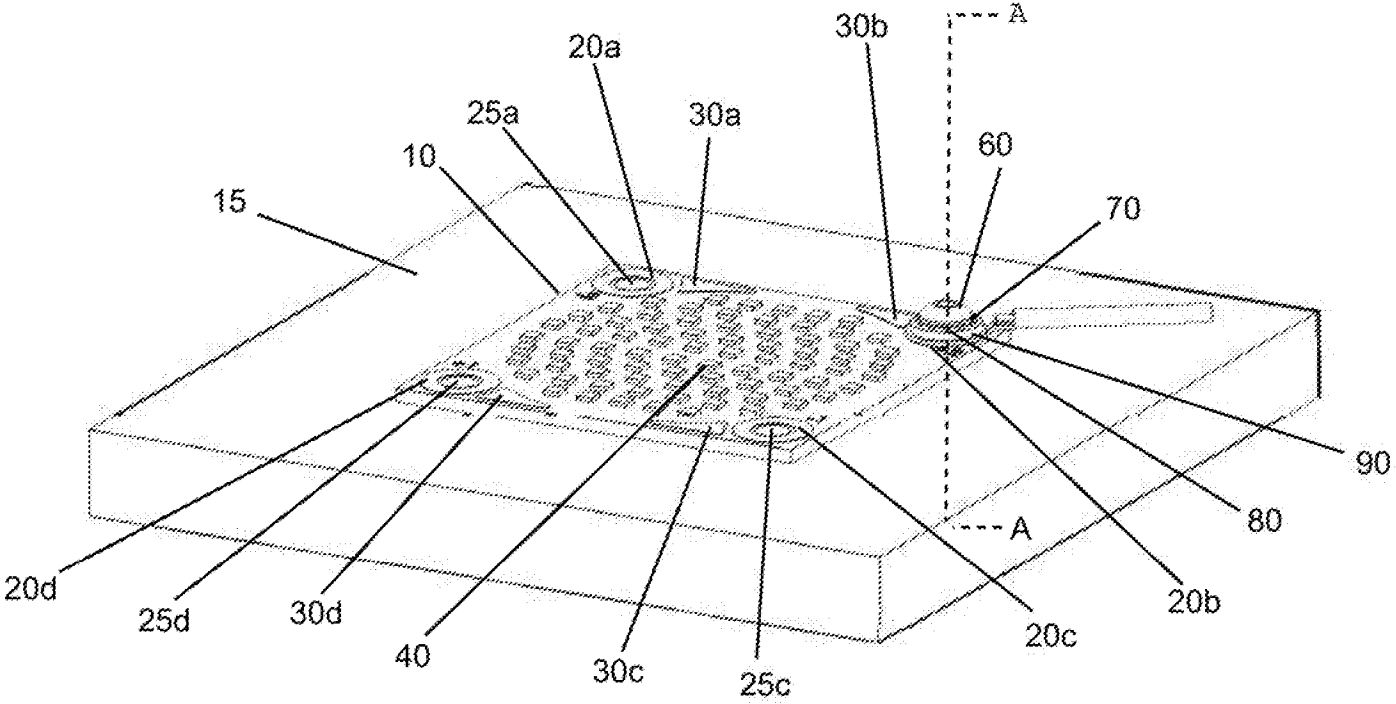
FIG. 3A is an assembled view of the LED assembly of FIG. 2.
Figure 3B:
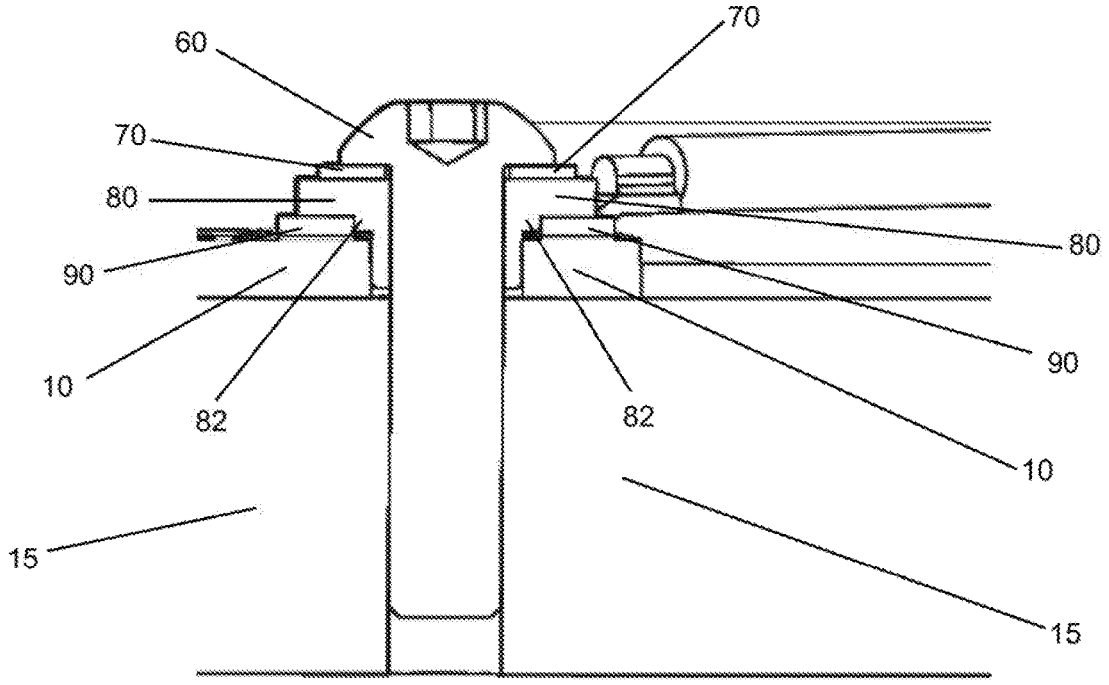
FIG. 3B is a sectional view of the LED assembly of FIGS. 2, 3A taken along section line A-A.

FIGS. 2, 3A-B show an exemplary embodiment of an LED assembly 50 that includes the LED component 10 of FIG. 1. In this exemplary embodiment, the LED assembly 50 may further include a fastener 60, a washer 70, a bushing 80, and an electrical terminal 90. The electrical terminal 90 is shown as a ring terminal, including an aperture 95 formed therethrough. In addition, the washer 70 and the bushing 80 may include apertures 75, 85 formed therethrough, respectively.

The fastener 60 may be configured to pass through the respective apertures 75, 85, 95, 25*b* formed in the washer 70, the bushing 80, the electrical terminal 90, and the LED component 10 to mechanically attach the components to a heatsink 15 at aperture 17*b*. When assembled, the fastener 60 applies a mounting force to the electrical terminal 90 and the LED component 10 to electrically connect the LED component 10 to a power source or an electrical driver (not shown) via the electrical terminal 90. That is, the electrical terminal 90 may be in at least partial contact with the electrical pad 20*b* on the LED component 10 to electrically connect the LED component 10 to the power source or the electrical driver. When the electrical terminal 90 is in at least partial contact with the electrical pad 20*b*, the electrical pad 20*b* may direct power to the LED array 40.

The bushing 80 may be a non-conductive material, and positioned and shaped accordingly to insulate the electrical terminal 90 from the fastener 60 and the washer 70. The bushing 80 may optionally include a shoulder 82 to aid assembly by centering the electrical terminal 90 so that it is aligned with the electrical pad 20*b*. In addition, the bushing 80 may align the electrical terminal 90 with the respective apertures 25*b*, 17*b* formed in the LED component 10 and the heatsink 15. The washer 70 may be positioned underneath the fastener 60, increasing the engagement level of the fastener 60 and preventing the fastener 60 from loosening over time.

The electrical connection between the LED component 10 and the power source or the electrical driver is solderless, allowing the LED and the connection(s) to be serviceable and re-usable for many cycles. For example, the fastener(s) (i.e. fastener 60) may be loosened, and the LED component 10 may be replaced without any soldering or wire replacement. In the exemplary embodiment shown in FIGS. 1-3B, the electrical connection between the LED component 10 and the power source and the mechanical attachment between the LED component 10 and the heatsink 15 are combined. That is, the fastener 60 applies a mounting force to the electrical terminal 90 and the LED component 10 to electrically connect the LED component 10 to the power source, and mechanically attaches the LED component 10 to the heatsink 15. This configuration and arrangement eliminates the need for separate connections for the electrical connection and the mechanical attachment.

The second plurality of electrical pads 30*a-d* on the LED component 10 allow a user to optionally solder an electrical terminal (not shown) to the LED component 10, if desired, to provide a more permanent electrical connection in addition to the electro-mechanical connection described above. The second plurality of electrical pads 30*a-d* also provide the option, if desired, to electrically connect the LED component 10 using traditional soldering methods instead of using the electrical terminal 90, and to use the fastener 60 for only mechanically attaching the LED component 10 to the heatsink 15. When an electrical terminal (not shown) is soldered to at least one of the second plurality of electrical pads 30*a-d*, the respective electrical pad may direct power to the LED array 40. In the embodiments shown in FIGS. 1-3B, the LED component 10 includes a second plurality of electrical pads 30*a-d*, but one or ordinary skill in the art will understand that other exemplary embodiments may not include the second plurality of electrical pads.

In the exemplary embodiment of the LED assembly 50 shown in FIGS. 2, 3A-B, the LED component 10 may be mechanically attached to the heatsink 15 and electrically connected to the power source or the electrical driver (not shown) at the other plurality of apertures 25*a*, 25*c*, 25*d* formed in the LED component 10 and the plurality of apertures 17*a*, 17*c*, 17*d* formed in the heatsink 15. For example, another fastener (not shown) may pass through the respective apertures 25*a*, 17*a* formed in the LED component 10 and the heatsink 15 to attach the LED component 10 and another washer, bushing, and electrical terminal (not shown) to the heatsink 15. That is, the additional fastener may provide another point of mechanical attachment for the LED component 10 and the heatsink 15, and the additional electrical terminal (not shown) may be in at least partial contact with the electrical pad 20*a* to provide another electrical connection between the LED component 10 and the power source. Similar to the electrical pad 30*b* discussed above, the electrical pad 30*a* allows a user to optionally solder an electrical terminal to the LED component 10, if desired.

As will be described in more detail by alternative exemplary embodiments below, depending on what the application and the LED component require, the LED component may include one or more apertures formed therethrough to be used for both mechanical attachment and electrical connection, and other aperture(s) for solely mechanical attachment. Furthermore, in the exemplary embodiment shown in FIGS. 1-3B, the LED component 10 is substantially square-shaped and there are four apertures 25*a-d* formed therethrough positioned towards the corners of the LED component 10. However, it will be understood by one of ordinary skill in the art that in other embodiments the LED component may be another shape and the apertures formed therethrough may be any number and located at a different position in the LED component. For example, the LED component, may be substantially rectangular, circular, or any other shape or contour. For example, there may be one, two, three, five, six, etc. apertures formed in the LED component. For example, the any number of apertures formed in the LED component may be positioned towards the middle of the LED component, sides of the LED component, etc. Furthermore, the apertures formed in the LED component may be a substantially equal distance apart from one another, or at different distances relative to the other. Even further, it will be understood by one of ordinary skill in the art that in other alternative embodiments, the LED component may include another type of fastening region in lieu of the aperture, including but not limited to a cut out.

In the embodiments disclosed, the fastener may be any fastener now or hereafter known in the art including, but not limited to, a serrated head fastener, a washer head fastener, a conventional screw, a washer head screw, a serration screw, etc. In alternative exemplary embodiments, the fastener may be composed of a plastic or other electrically insulating material. In such embodiments, a bushing may not be necessary, as the fastener is non-conductive and would not require shielding from the electrical terminal. In other alternative exemplary embodiments, the washer may not be necessary or the washer may be integral with the fastener (i.e. a washer head screw). For example, a thread screw, ovular screw, or another fastener that is resistant to vibration may be used and the washer may not be included. In other alternative exemplary embodiments, the electrical terminal may be molded into the bushing, forming an integral component for the electrical contact and the bushing.

Figure 10:
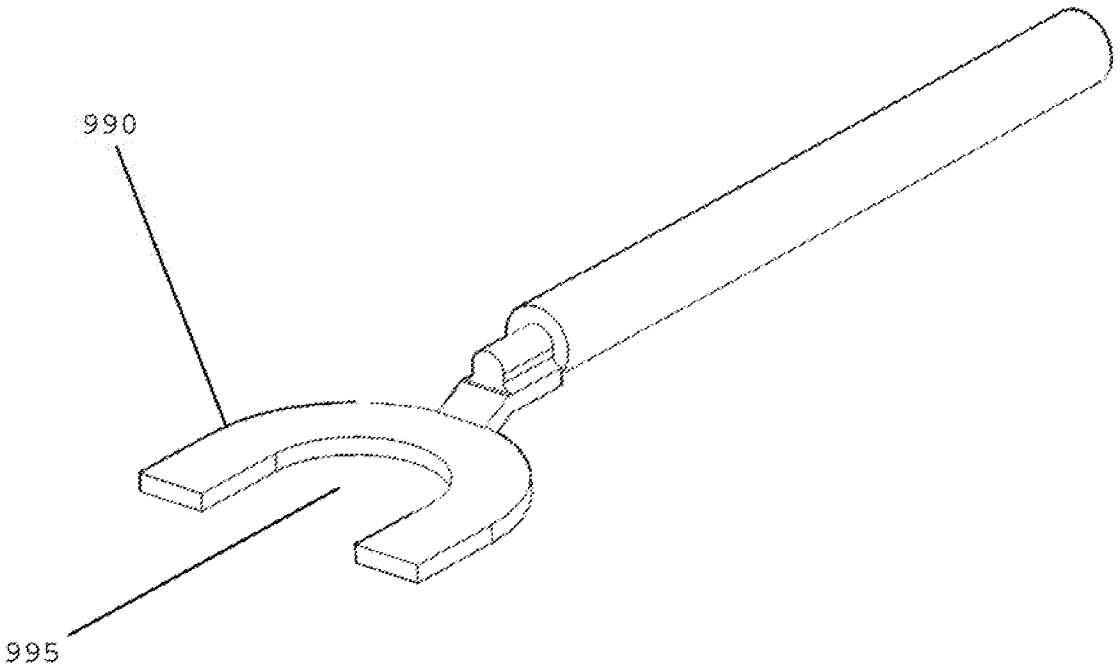
FIG. 10 is a perspective view of an exemplary embodiment of an open terminal.

In the exemplary embodiment shown in FIGS. 2, 3A-B, the electrical terminal is a ring terminal. However, one of ordinary skill in the art will understand that in other alternative exemplary embodiments, the electrical terminal may be an open terminal, as shown in FIG. 10 and described below. In addition, the electrical terminal is preferably a gold-plated conductive material to provide corrosion resistance. However, one of ordinary skill in the art will understand that in other alternative exemplary embodiments, the electrical terminal may not be gold-plated if the application does not require corrosion resistance (i.e. if used in an indoor, climate-controlled environment).

The exemplary embodiment shown in FIGS. 1-3B and described above eliminates the need for an LED holder to secure the LED component to a heatsink because the LED component is mechanically attached to the heatsink itself. Eliminating the LED holder lowers the cost of the device and saves additional space around the LED component as the heatsink only needs to be as large as the LED component. Furthermore, the LED fixture assembly is simplified, as the LED component is placed on the heatsink, and the fastener and the bushing help align the various components (i.e. heatsink, LED component, washer, electrical terminal, bushing). Without an LED holder, the LED assembly also has a lower profile, allowing an optic to be used because an LED holder is not in the way of the optic being positioned close to the LEDs. One of ordinary skill in the art will understand that further space may be saved by using a fastener with a low profile. In addition, the electro-mechanical connection saves space on the LED component, as the electrical connection and mechanical attachment make up one connection as opposed to being separate connections.

Figure 4:
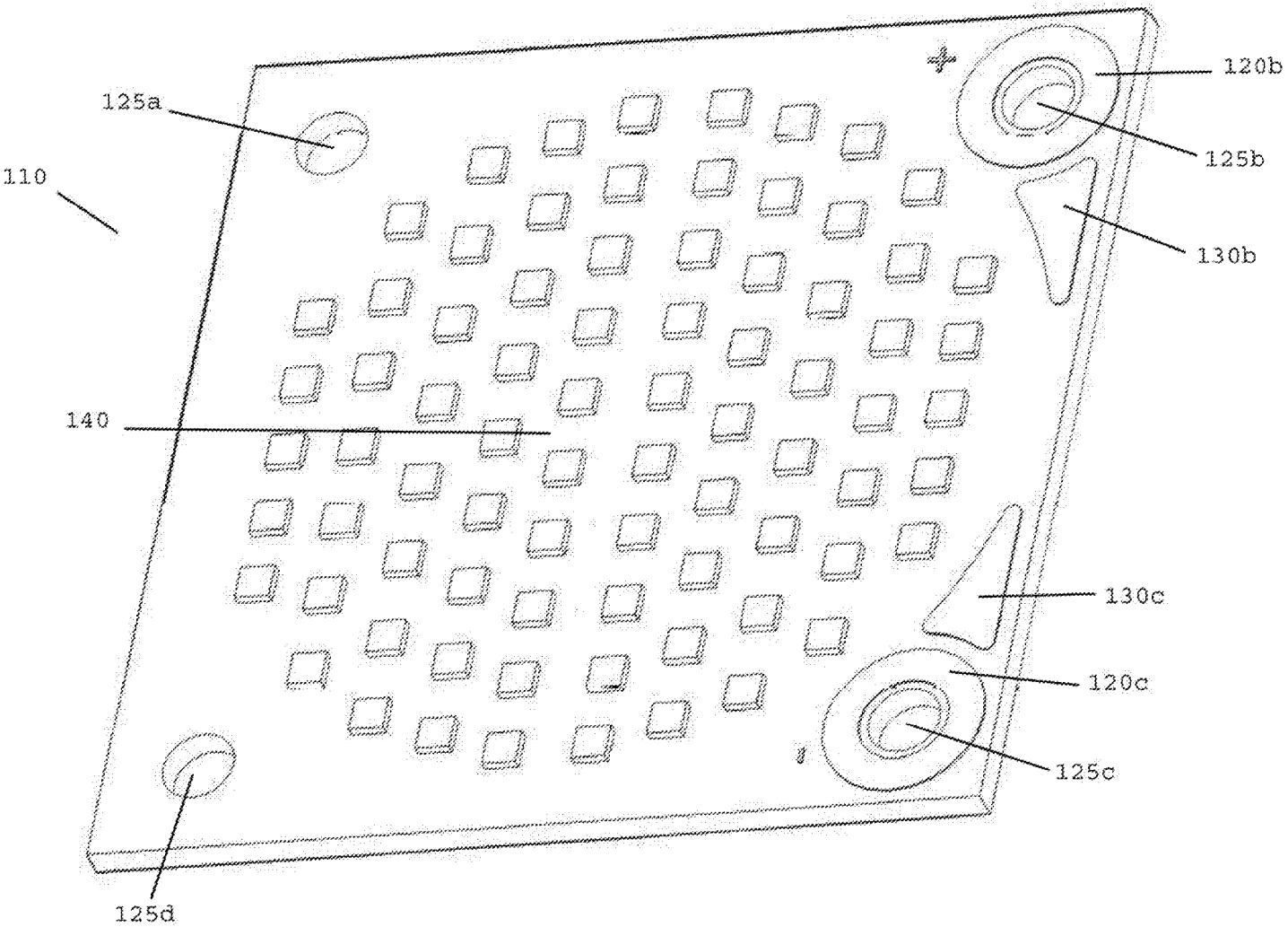
FIG. 4 is a perspective view of an exemplary embodiment of an LED component.

FIG. 4 shows an alternative exemplary embodiment of an LED component 110 of an LED assembly (not shown) that is substantially similar to the LED component 10 and corresponding LED assembly 50 illustrated in FIGS. 1-3B and discussed above, but for the following additional features. The LED component 110 may include a plurality of apertures 125*a-d* formed therethrough. An electrical pad 120*b* may at least partially surround the aperture 125*b*, and an electrical pad 120*c* may at least partially surround the aperture 125*c*. In a preferable embodiment, the electrical pads 120*b*, 120*c* are centered about the plurality of apertures 125*b*, 125*c*, respectively. Electrical pads 130*b*, 130*c* allow a user to optionally solder an electrical terminal to the LED component 110, if desired. Electrical pads do not surround apertures 125*a*, 125*d*. In use, the LED component 110 may be mechanically attached to the heatsink (not shown) at apertures 125*a*, 125*d* using a fastener. Furthermore, the LED component 110 may be both mechanically attached to the heatsink and electrically connected to a power source (as similarly described above and shown above in exemplary embodiments of FIGS. 1-3B) at apertures 125*b*, 125*c*. That is, the LED component 110 is a single circuit LED array, and may include both mechanical mounting points (i.e. apertures 125*a*, 125*d*) and electro-mechanical mounting points (i.e. apertures 125*b*, 125*c*), in which the electro-mechanical mounting points are on the same side of the LED component 110.

Alternatively, the electrical pad 120*b* may be positioned to at least partially surround the aperture 125*a*; and in a preferable embodiment, the electrical pad 120*b* may be positioned to be centered about the aperture 125*a*. In addition, the electrical pad 130*b* may be positioned closer to the aperture 125*a* (for example, similar to the electrical pad 30*a* in FIG. 1) to allow a user to optionally solder an electrical terminal to the LED component. In this embodiment, the LED component 110 would be mechanically attached to the heatsink (not shown) at apertures 125*a*, 125*c* using a fastener. In such configuration, the LED component is a single circuit LED array, and includes both mechanical mounting points and electro-mechanical mounting points, in which the electro-mechanical mounting points are on opposite sides of the LED component.

Figure 5:
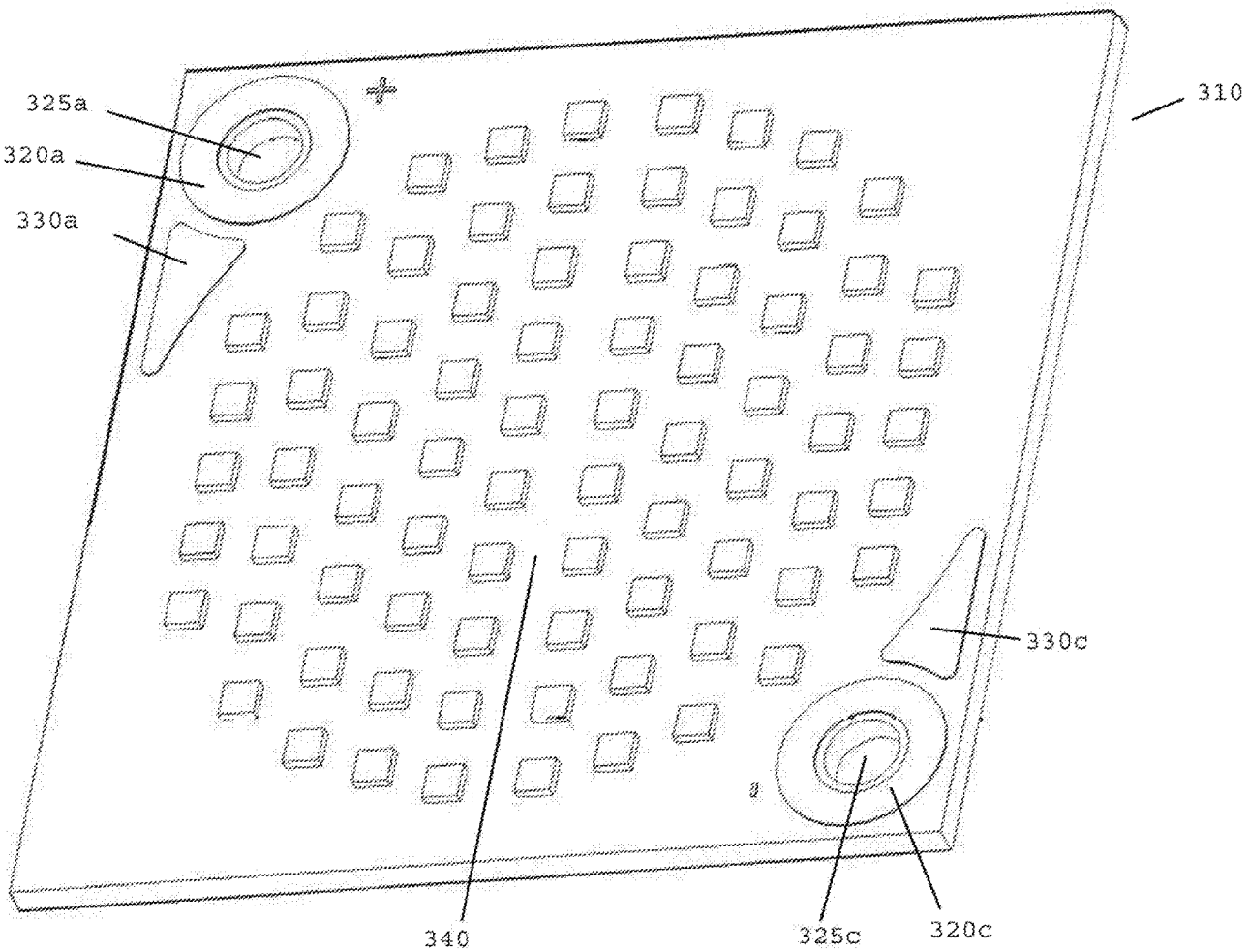
FIG. 5 is a perspective view of an exemplary embodiment of an LED component.

FIG. 5 shows another alternative exemplary embodiment of an LED component 310 of an LED assembly (not shown) that is substantially similar to the LED component 10 and corresponding LED assembly 50 illustrated in FIGS. 1-3B and discussed above, but for the following additional features. The LED component 310 may include a plurality of apertures 325*a*, 325*c* formed therethrough. An electrical pad 320*a* may at least partially surround the aperture 325*a*, and an electrical pad 320*c* may at least partially surround the aperture 325*c*. In a preferable embodiment, the electrical pads 320*a*, 320*c* are centered about the plurality of apertures 325*a*, 325*c*, respectively. The electrical pads 330*a*, 330*c* allow a user to optionally solder an electrical terminal to the LED component 310, if desired. In use, the LED component 310 may be both mechanically attached to the heatsink (not shown) and electrically connected to a power source (as similarly described and shown above in exemplary embodiments of FIGS. 1-3B) at apertures 325*a*, 325*c*. That is, the LED component 310 is a single circuit LED array, and may include electro-mechanical mounting points (i.e. apertures 325*a*, 325*c*) which are on opposite sides of the LED component 310.

Figure 6A:
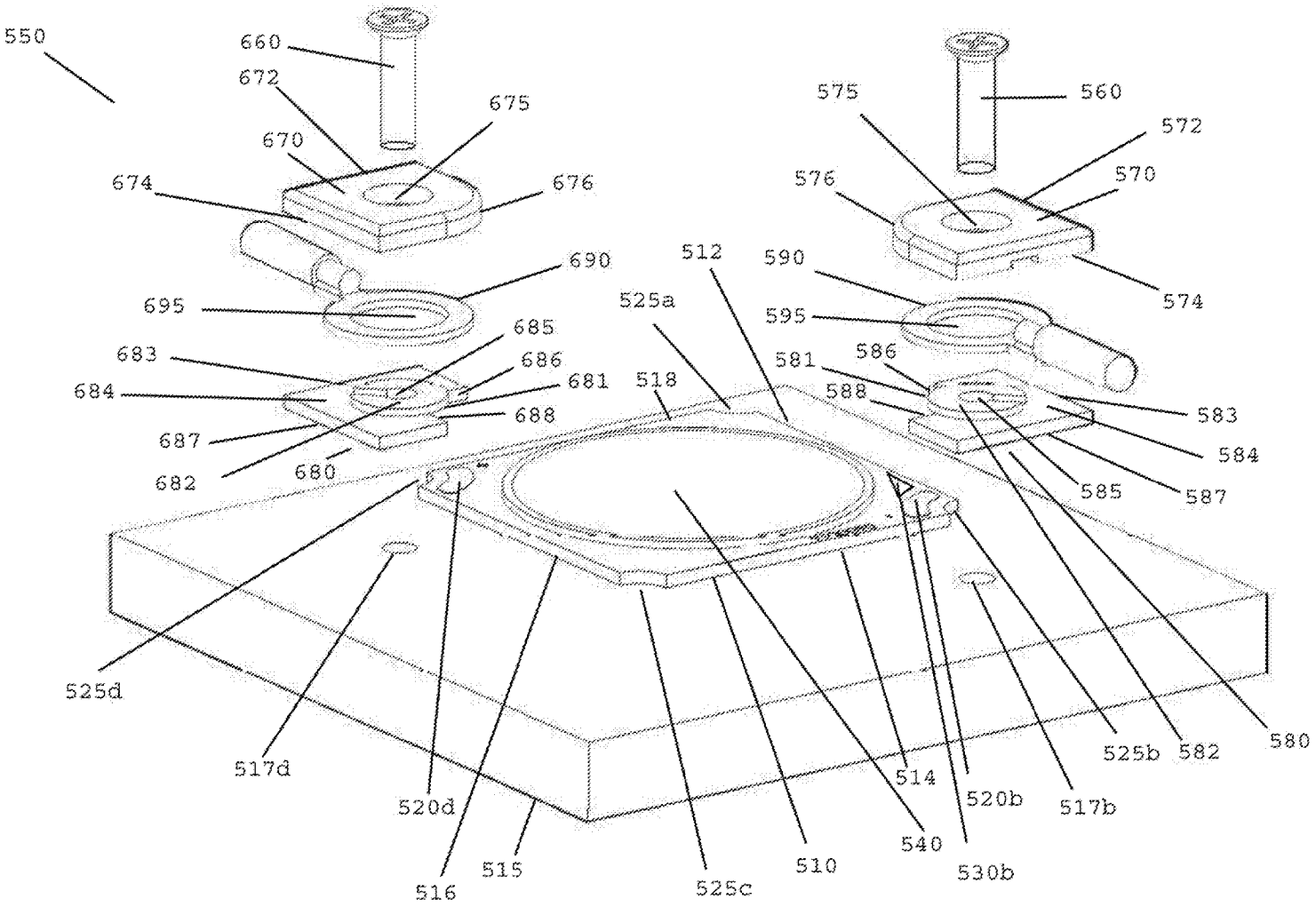
FIG. 6A is an exploded view of an exemplary embodiment of a COB assembly.
Figure 6B:
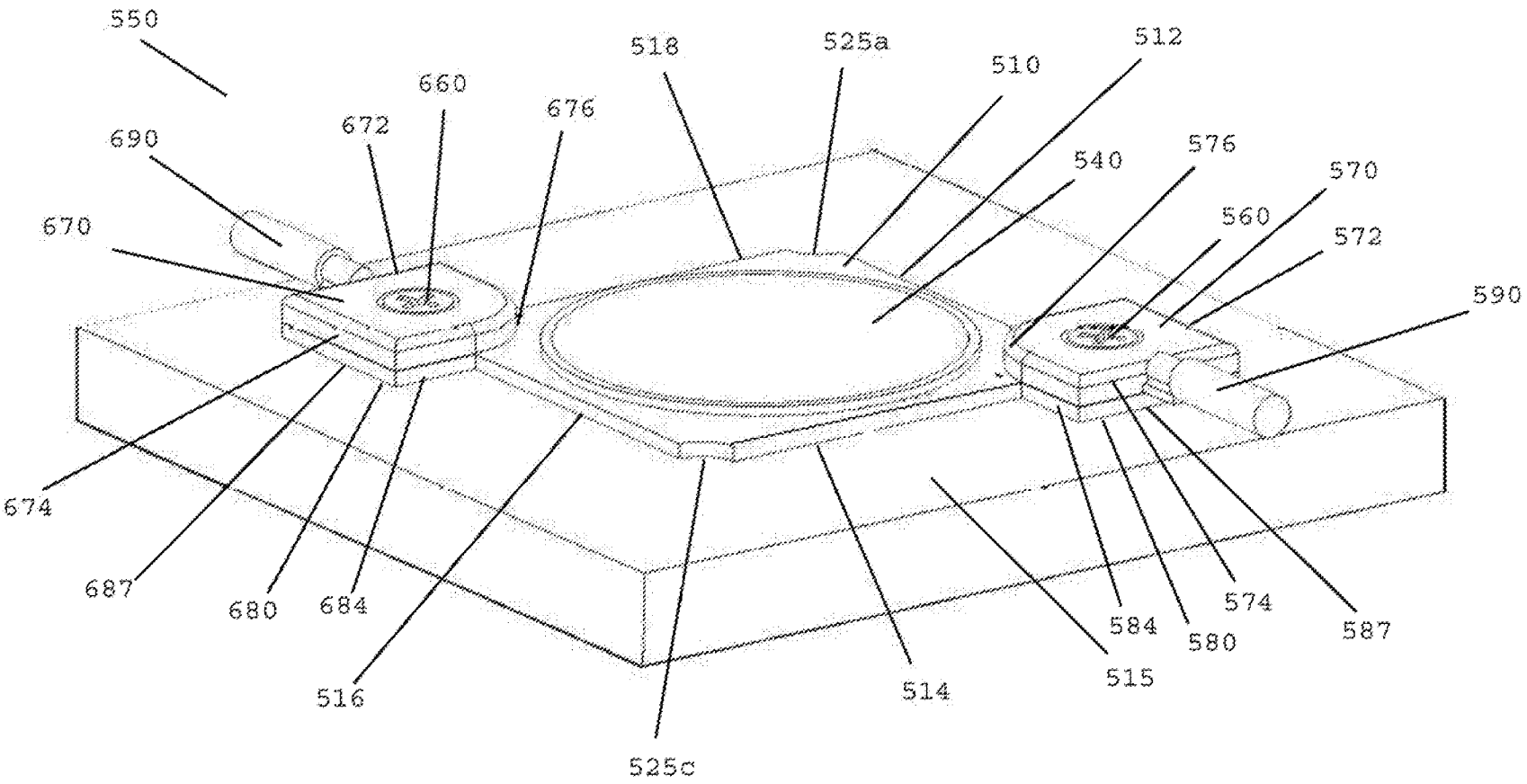
FIG. 6B is an assembled view of the COB assembly of FIG. 6A.

FIGS. 6A-B show another alternative exemplary embodiment of a COB assembly 550 including COB component 510, that is substantially similar to the LED assembly 50 illustrated in FIGS. 2-3B and the LED component 10 shown in FIG. 1 and discussed above, but for the following additional features. The COB assembly 550 may include a COB component 510, first and second bushings 580, 680, first and second electrical terminals 590, 690, first and second washers 570, 670, and first and second fasteners 560, 660. The COB component 510 is a single circuit LED array, and may include a plurality of cut outs or "mouse bites" 525*a-d* at the corners. The cut outs 525*a-d* may be preferable in applications with small fixtures or COBs/LEDs where there is not a lot of room on the component for fasteners. A first electrical pad 520*b* may be positioned on the COB component 510 adjacent to the cut out 525*b*, and a second electrical pad 520*d* may be positioned on the COB component 510 adjacent to the cut out 525*d*. One or more additional electrical pad(s) (i.e. electrical pad 530*b*) may be positioned on the COB component 510 to allow a user to optionally solder an electrical terminal to the COB component 510, if desired.

The first bushing 580 may include a lower portion 584 and a raised portion 582, in which the raised portion 582 projects from the lower portion 584 and has an outer circumference 581. The lower portion 584 of the first bushing 580 may include a first side 586, a second side 588, a third side 583, and a fourth side 587. When assembled, the first bushing 580 may be adapted and configured so that it is positioned around the cut out 525*b* of the COB component 510. The first side 586 of the first bushing 580 may be adapted and configured to align with and be adjacent to a first side 512 of the COB component 510, and the second side 588 of the first bushing 580 may be adapted and configured to align with and be adjacent to a second side 514 of the COB component 510. The lower portion 584 of the first bushing 580 may extend beyond the perimeter of the COB component 510, providing support for the COB component 510. The first bushing 580 may also provide support for the first electrical terminal 590 and corresponding electrical connection, as the first electrical terminal 590 may rest on the lower portion 584 of the first bushing 580 with a portion of the first electrical terminal 590 being in contact with the first electrical pad 520*b*, and the raised portion 582 of the first bushing 580 being adapted and configured to fit within the aperture 595 of the first electrical terminal 590.

A first washer 570 may include a first side 572, a second side 574, a rounded corner 576, and an aperture 575 formed therein. When assembled, the first side 572 may be adapted and configured to align with the third side 583 of the first bushing 580, and the second side 574 may be adapted and configured to align with the fourth side 587 of the first bushing 580. The rounded corner 576 may be adapted and configured to align with the contour of the first electrical terminal 590, and the first washer 570 may be adapted and configured to cover the first electrical terminal 590 and the first electrical pad 520*b* on the LED component 510.

When assembled, the first fastener 560 passes through the aperture 575 formed through the first washer 570, the aperture 595 formed through the first electrical terminal 590, the aperture 585 formed through the first bushing 580, and the aperture 517*b* formed through the heatsink 515 to mechanically attach the COB component 510, first bushing 580, first electrical terminal 590, and first washer 570 to the heatsink 515. The electrical terminal 590 is in at least partial contact with the first electrical pad 520*b* on the COB component 510 to electrically connect the COB component 510 to a power source (not shown). When the first electrical pad 520*b* is in at least partial contact with the first electrical terminal 590, the first electrical pad 520*b* may direct power to the COB array 540. It will be understood by one of ordinary skill in the art that in alternative embodiments, the COB assembly may not include the washer and/or bushing, such as embodiments in which the fastener is made of a non-conductive material.

The COB component 510 and the corresponding second electrical pad 520*d*, second bushing 680, second electrical terminal 690, second washer 670, and second fastener 660 may all be assembled to the heatsink 515 at the aperture 517*d* in the same manner as the COB component 510, first bushing 580, first electrical terminal 590, first washer 570, and first fastener 560 are assembled to the heatsink 515 at aperture 517*b* (as described above). In use, the COB component 510 may be electrically connected to a power source using the first and second electrical pads 520*b*, 520*d*, and mechanically attached to the heatsink 515. That is, the COB assembly 550 may include electro-mechanical mounting points, in which the electro-mechanical mounting points are on opposite sides of the COB component 510. This configuration helps prevent the COB component 510 from being displaced.

An LED or COB component 510 including a plurality of mouse bites 525*a-d* at the corners (such as shown in the exemplary embodiment shown in FIGS. 6A-B and described above) is particularly useful in applications having small LED fixtures, LED or COB components, and/or circuit boards where there is not a lot of room on the component for fasteners.

Figure 7A:
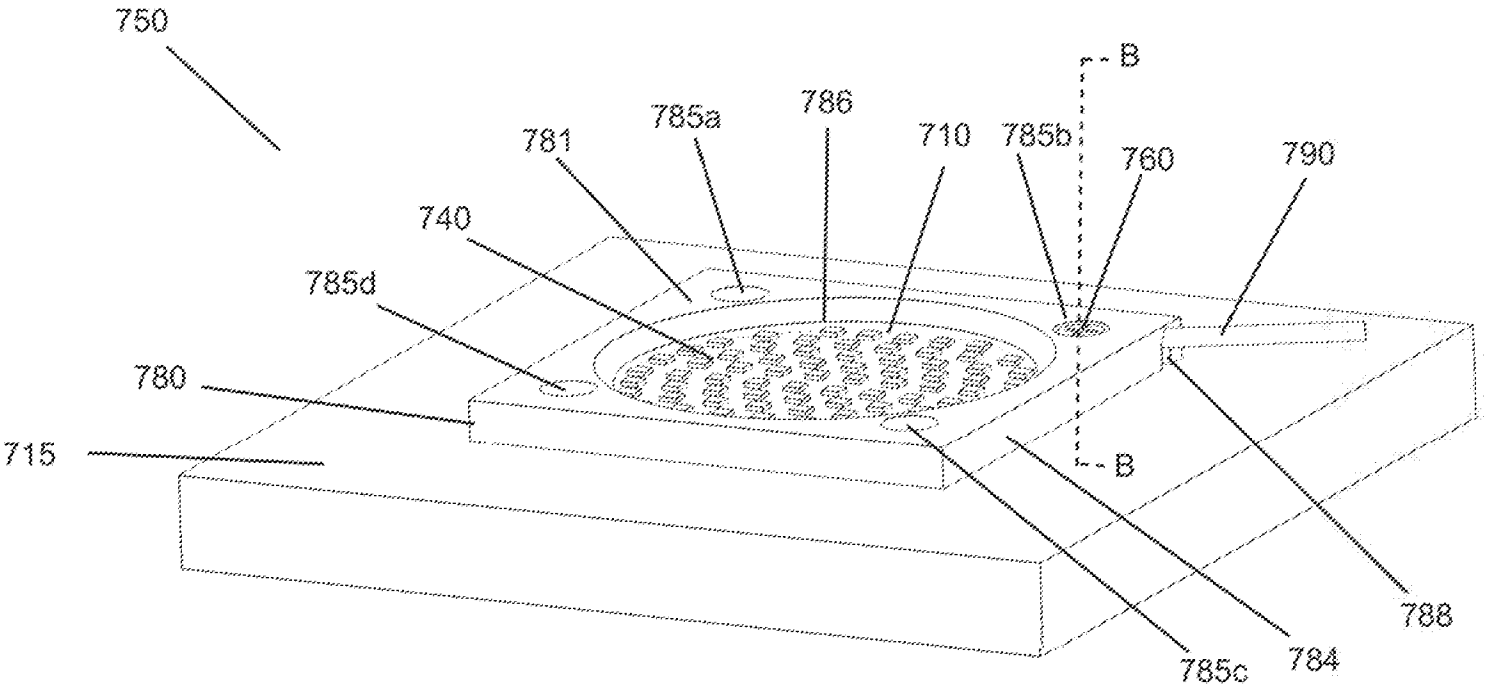
FIG. 7A is an assembled view of an exemplary embodiment of an LED assembly.
Figure 7B:
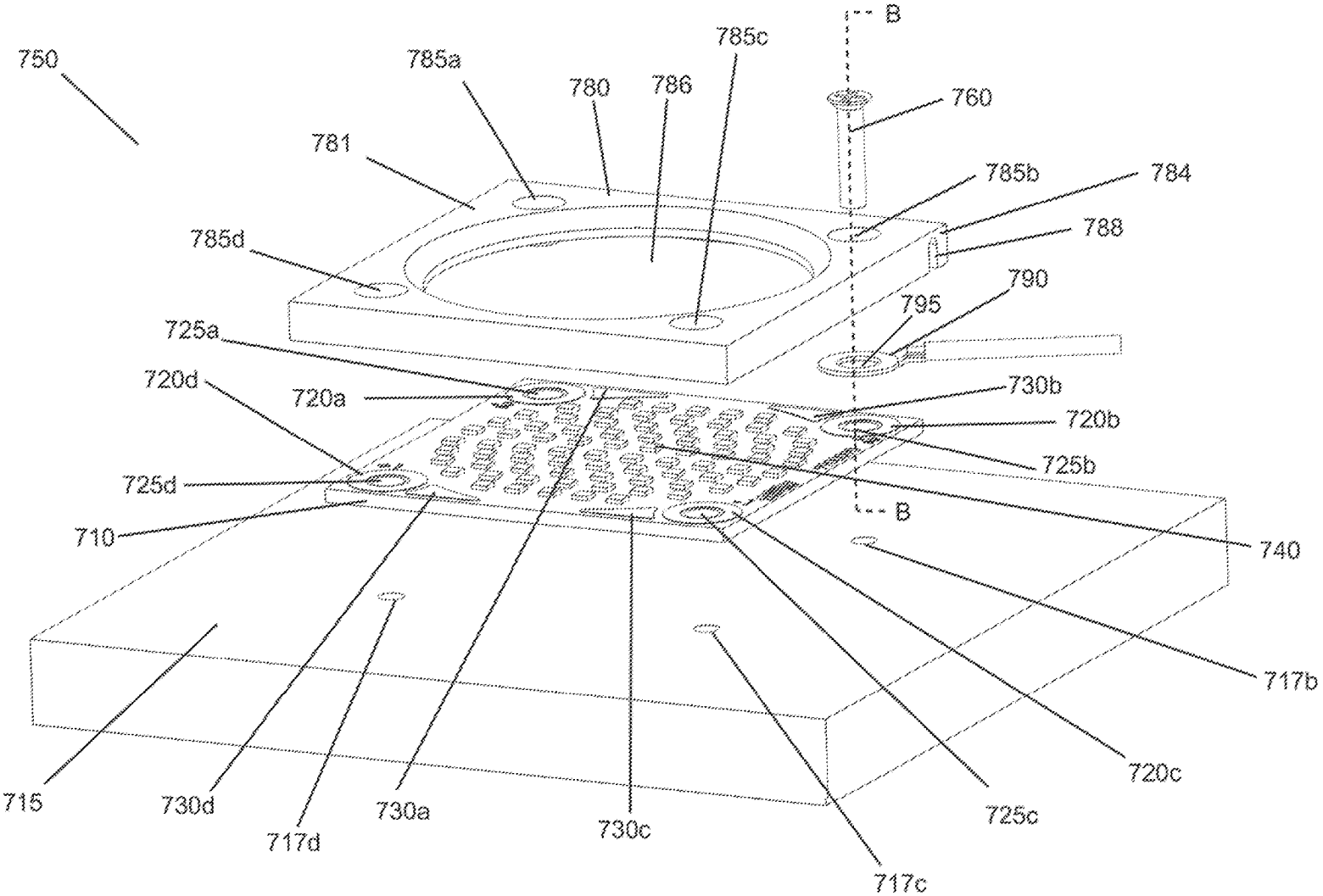
FIG. 7B is an exploded view of the LED assembly of FIG. 7A.
Figure 7C:
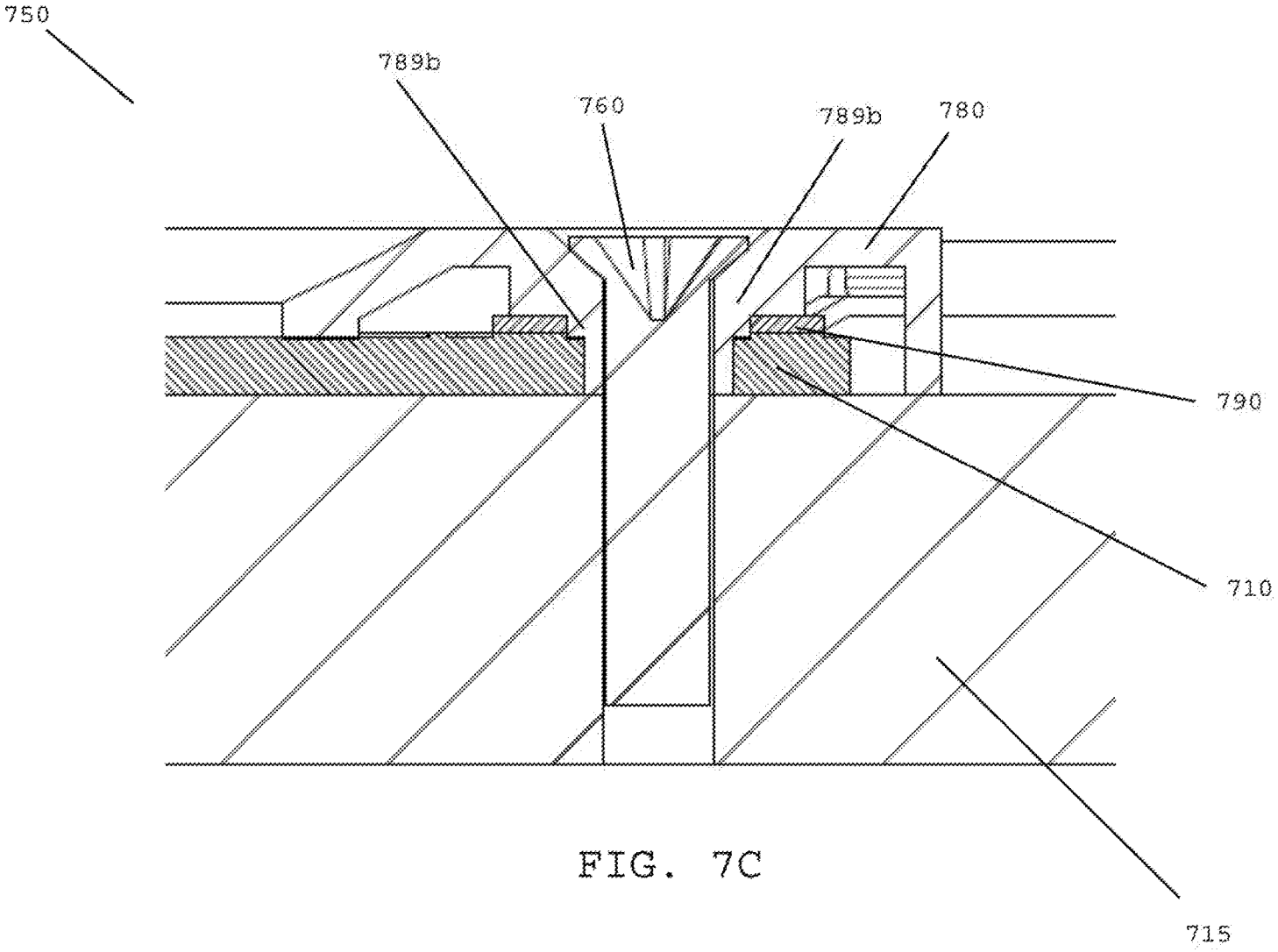
FIG. 7C is a sectional view of the LED assembly of FIGS. 7A-B taken along section line B-B.
Figure 8:
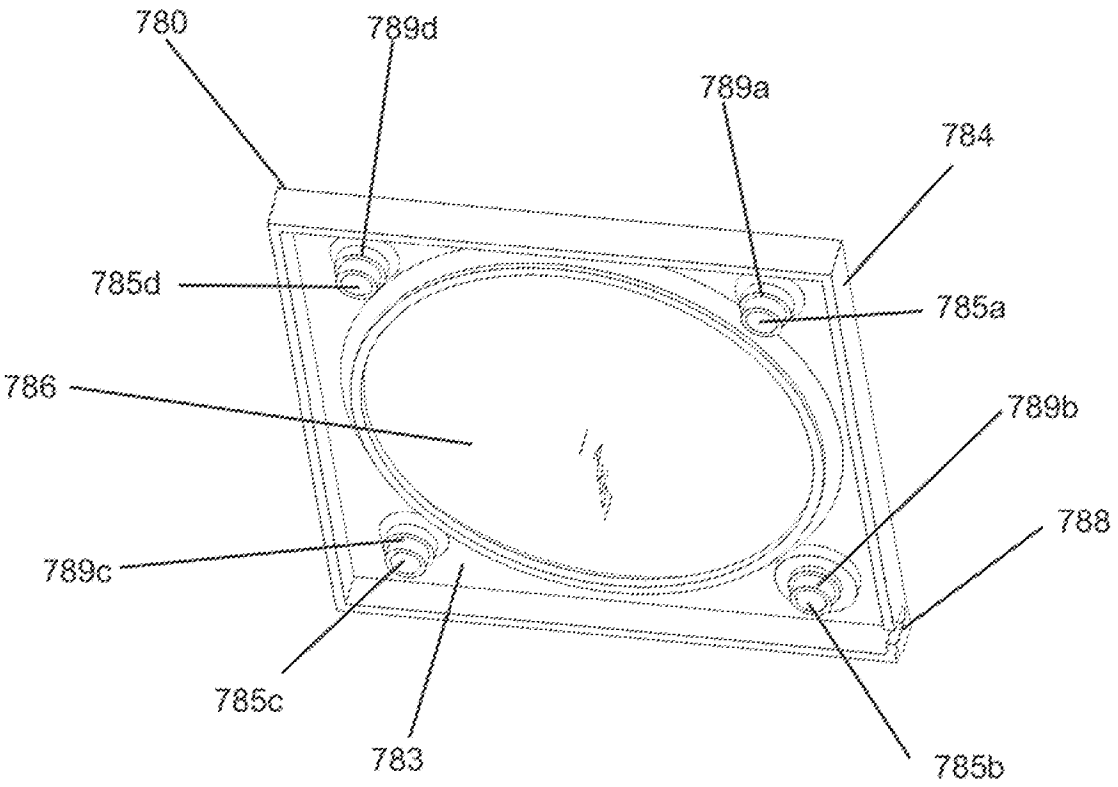
FIG. 8 is a bottom perspective view of a bushing of the LED assembly of FIGS. 7A-C.

FIGS. 7A-C show another alternative exemplary embodiment of an LED assembly 750 including an LED component 710 that is substantially similar to the LED component 10 and corresponding LED assembly 50 illustrated in FIGS. 1-3B and discussed above, but for the following additional features.

As shown in FIGS. 7A-C and 8, a bushing 780 may include apertures 785*a-d,* 786 formed through a top surface 781 of the bushing 780. The bushing 780 may also include extrusions 789*a-d* that extend from a bottom surface 783 of the bushing 780 around the respective apertures 785*a-d.* In addition, the bushing 780 may include a slot 788 formed through a side 784 of the bushing 780. The bushing 780 is sized to cover the LED component 710. In some alternative embodiments, the bushing may also include features, such as but not limited to twist and lock components, snap-in components, additional apertures, etc. to attach secondary optics (not shown) to the bushing using a fastener (i.e. screw), twist and lock components, snap-in components, etc.

In use, the LED component 710 is placed on the heat sink 715 so that apertures 725*a-d* substantially align with the respective apertures 717*a-d* formed in the heat sink 715, and the bushing 780 is placed over the LED component 710. The aperture 786 substantially aligns with the LED array 740, and the apertures 785*a-d* substantially align with the respective apertures 725*a-d* formed in the LED component 710. The appropriate number of electrical terminal(s) (i.e. electrical terminal 790) are positioned in between the LED component 710 and the bushing 780. As shown in FIGS. 7A-C, the terminal 790 is in at least partial contact with electrical pad 720*b,* and the aperture 795 formed in the electrical terminal 790 substantially aligns with the aperture 725*b* formed in the LED component 710. The electrical terminal 790 extends through the slot 788 of the bushing. Other electrical terminals (not shown) may be similarly positioned at one or more of the other electrical pads 720*a,* 720*c,* 720*d.*

A fastener 760 may extend through the respective apertures 785*b,* 795, 725*b,* and 717*b* of the bushing 780, the electrical terminal 790, the LED component 710, and the heat sink 715 to mechanically attach the respective components, and electrically connect the LED component 710 to a power source (not shown) by maintaining the contact between the electrical pad 720*b* and the electrical terminal 790. That is, the fastener 760 applies a mounting force to the electrical terminal 790 and the LED component 710 to electrically connect the LED component 710 to the power source, and mechanically attach the LED component 710 (and the bushing 780) to the heatsink 715.

As shown in FIG. 7C, when assembled, the extrusion 789*b* at least partially surrounds the fastener 760 and is made of a non-conductive material to insulate the electrical terminal 790 from the fastener 760. The bushing 780 is sized to cover the LED component 710, resulting in the bushing 780 aligning the other components during assembly, insulating the electrical terminal 790 from the fastener 760, and acting as a cover for the LEDs.

Figure 9A:
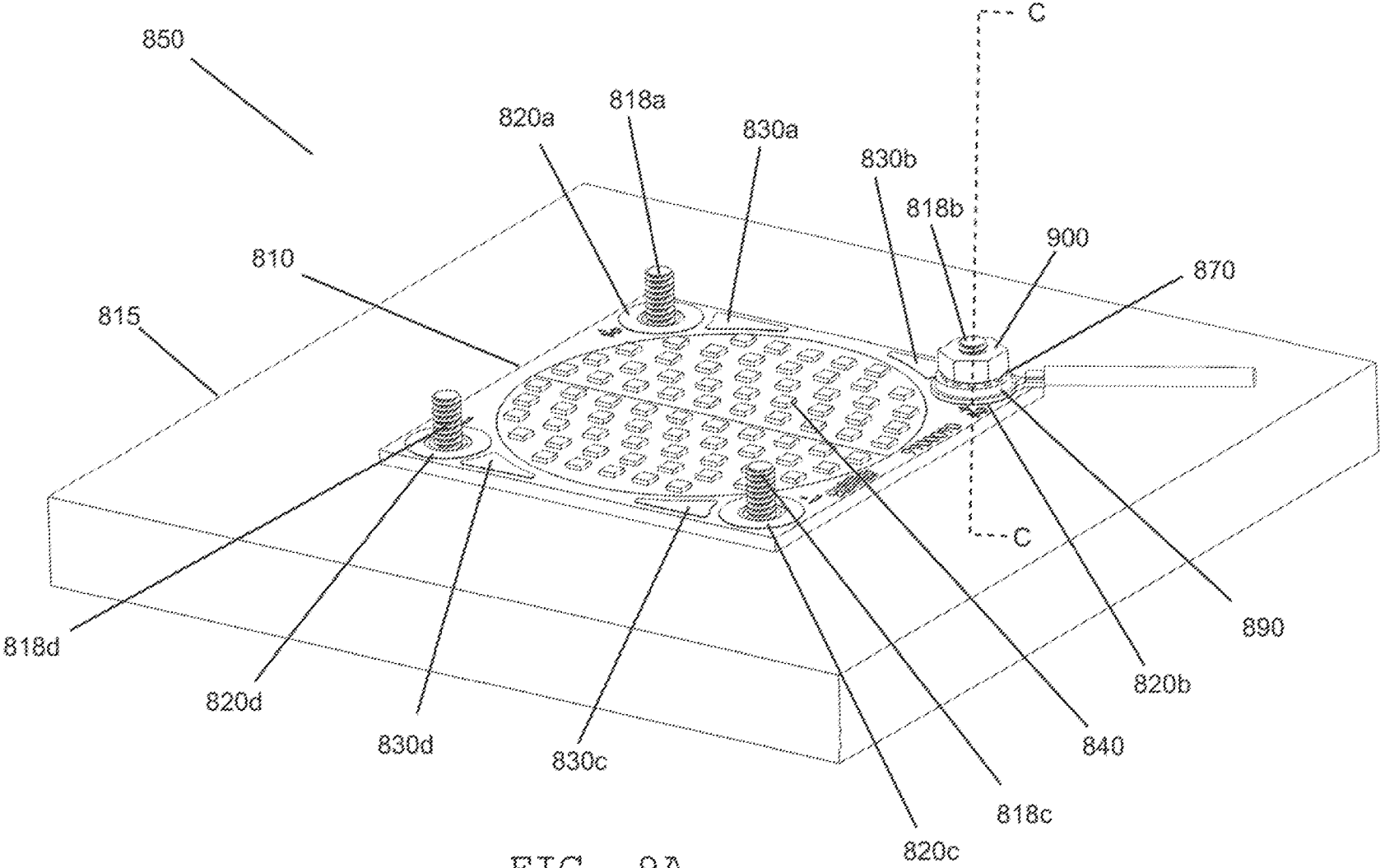
FIG. 9A is an assembled view of an exemplary embodiment of an LED assembly.
Figure 9B:
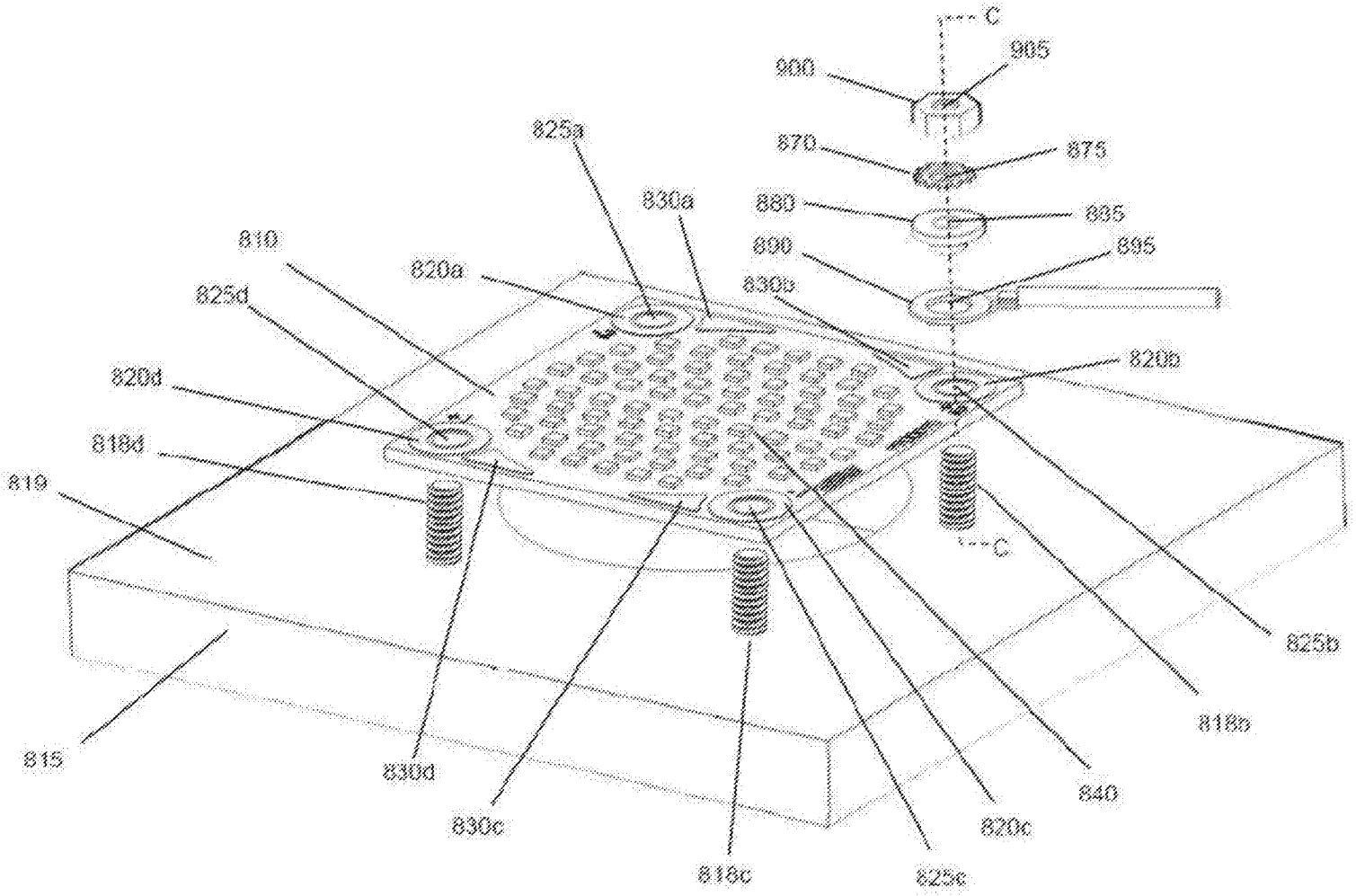
FIG. 9B is an exploded view of the LED assembly of FIG. 9A.
Figure 9C:
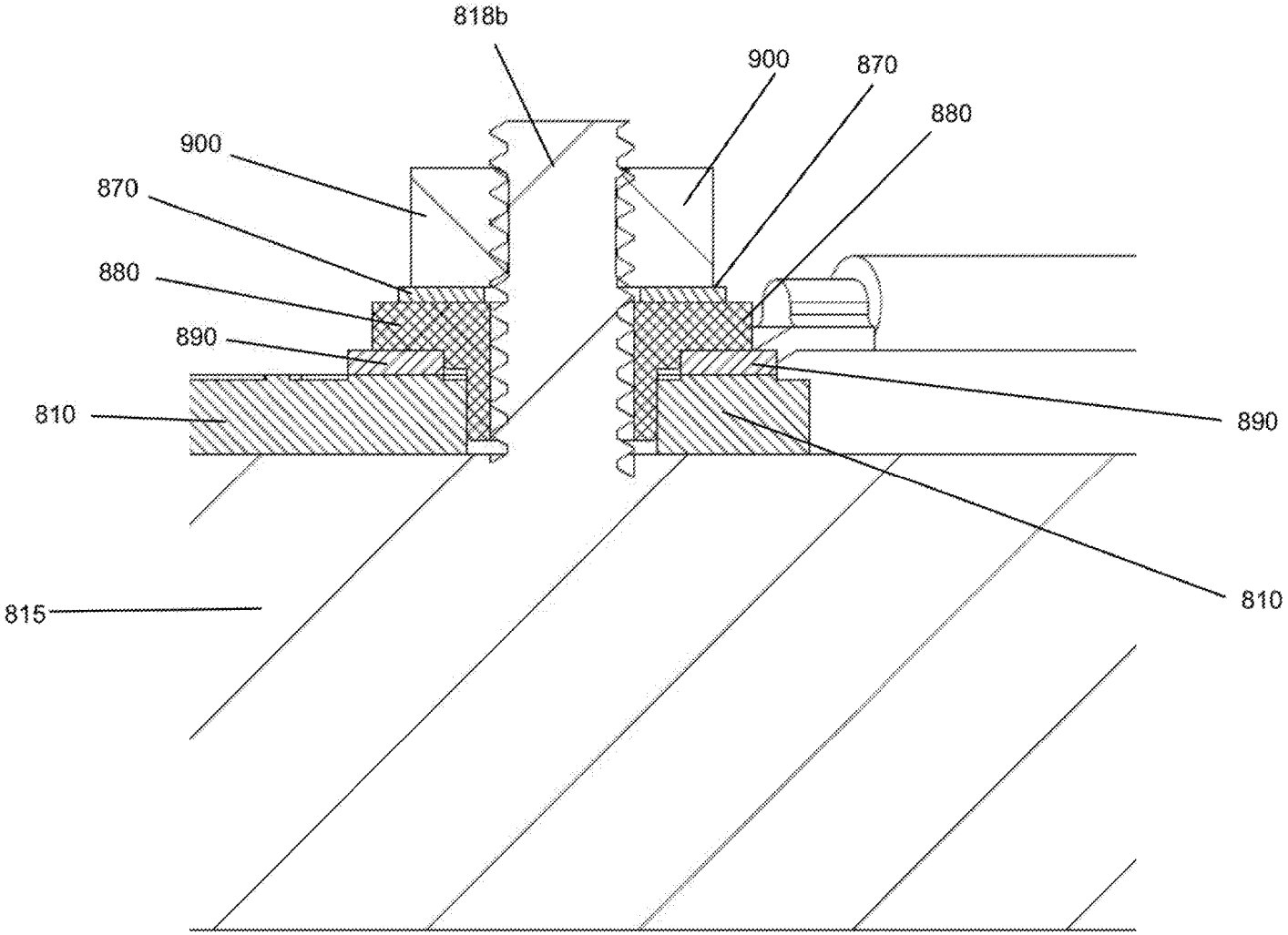
FIG. 9C is sectional view of the LED assembly of FIGS. 9A-B taken along section line C-C.

FIGS. 9A-C show another alternative exemplary embodiment of an LED assembly 850 including an LED component 810 that is substantially similar to the LED component 10 and corresponding LED assembly 50 illustrated in FIGS. 1-3B and discussed above, but for the following additional features.

The LED assembly 850 may include an electrical terminal 890, a bushing 880, a washer 870, and a nut 900. The electrical terminal 890, the bushing 880, the washer 870, and the nut 900 each include a respective aperture 895, 885, 875, 905 formed therethrough. One or more studs (i.e. studs 818*a-d*) may extend from a top surface 819 of the heat sink 815. In use, the studs 818*a-d* may substantially align with and extend through the respective apertures 825*a-d* of the LED component 810, and the LED component 810 may be positioned on the top surface 819 of the heatsink 815. The electrical terminal 890 may be positioned so the stud 818*b* extends through the aperture 895 and the electrical terminal 890 is in at least partial contact with the electrical pad 820*b* of the LED component 810. In addition, the stud 818*b* may extend through the respective apertures 885, 875, 905 formed in the bushing 880, the washer 870, and the nut 900. The bushing 880 is positioned between the electrical terminal 890 and the washer 870/nut 900, insulating the electrical terminal 890 from the washer 870, the nut 900, and the stud 818*b.* The stud 818*b* and the nut 900 may be threaded. The nut 900 applies a mounting force to mechanically attach the respective components to the heat sink 815 and electrically connect the LED component 810 to a power source (not shown) by maintaining the contact between the electrical pad 820*b* and the electrical terminal 890.

FIG. 10 shows an exemplary embodiment of an electrical terminal 990 which is an open terminal. The electrical terminal 990 includes an opening 995 formed therethrough. The opening 995 in the electrical terminal 990 is configured to substantially align with a respective aperture formed in a LED or COB component (i.e. aperture 25*b* of FIG. 1). In addition, the electrical terminal 990 is configured to at least partially contact an electrical pad on a LED or COB component (i.e. electrical pad 20*b* of FIG. 1). It will be understood by one of ordinary skill in the art that the open terminal 990 may be used instead of a ring terminal in any of the embodiments shown in FIGS. 1-2, 3A-B, 4-5, 6A-B, 7A-C, 9A-C and described above. The open terminal 990 is preferably a gold-plated material to provide corrosion resistance. However, one of ordinary skill in the art will understand that in other alternative exemplary embodiments, the electrical terminal 990 may not be gold-plated if the application does not require corrosion resistance (i.e. used in an indoor, climate-controlled environment).

It will be understood by one of ordinary skill in the art that any of the exemplary embodiments, or other embodiments within the scope envisioned by one of ordinary skill in the art, may include a COB component instead of an LED component, or an LED component instead of a COB component. Likewise, any of the exemplary embodiments, or other embodiments within the scope envisioned by one of ordinary skill in the art, may include a COB assembly instead of an LED assembly, or an LED assembly instead of a COB assembly.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision additional modifications, features, and advantages within the scope and spirit of the claims appended hereto.

What is claimed is:

1. A light emitting diode (LED) assembly for attaching to a heatsink and electrically connecting to a power source, the LED assembly comprising:

a. an LED component including at least one electrical pad, the LED component including an aperture formed therethrough;

b. at least one electrical terminal at least partially in contact with a corresponding one of the electrical pads, wherein the electrical terminal is adapted and configured to electrically connect the LED component to the power source;

c. a fastener arranged and configured to maintain the contact of at least one of the electrical terminals to a corresponding one of the electrical pads and mechanically attach the LED component to the heatsink; and d. wherein at least one of the electrical terminals includes an aperture formed therethrough, wherein the aperture formed in the electrical terminal is substantially aligned with the aperture formed in the LED component, and wherein the fastener passes through both the aperture formed in the LED component and the aperture formed in the electrical terminal.

2. The LED assembly of claim 1 further comprising a bushing configured to insulate the fastener from the electrical terminal.

3. The LED assembly of claim 2, wherein the bushing includes a shoulder configured to substantially align the electrical terminal with the electrical pad.

4. The LED assembly of claim 2, wherein the bushing is sized to cover the LED component.

5. The LED assembly of claim 1 further comprising a washer positioned underneath the fastener.

6. The LED assembly of claim 1, wherein the fastener is one selected from the group consisting of a serrated head fastener or a washer head fastener.

7. The LED assembly of claim 1 further comprising a plurality of second electrical pads and a plurality of second electrical terminals, wherein at least one of the plurality of second electrical pads is configured for a solder connection with a corresponding one of the second electrical terminals.

8. A light emitting diode (LED) assembly for attaching to a heatsink and electrically connecting to a power source, the LED assembly comprising:

a. an LED component including at least one electrical pad, the LED component including an aperture formed therethrough and at least one of the electrical pads is centered about the aperture;

b. at least one electrical terminal at least partially in contact with a corresponding one of the electrical pads, wherein the electrical terminal is adapted and configured to electrically connect the LED component to the power source; and c. a fastener configured to pass through said aperture and arranged and configured to maintain the contact of at least one of the electrical terminals to a corresponding one of the electrical pads and mechanically attach the LED component to the heatsink.

9. The LED assembly of claim 1, wherein the aperture is a first aperture and the fastener is a first fastener, and wherein the LED component includes a second aperture formed therethrough, and wherein a second fastener passes through the second aperture to attach the LED component to the heatsink.

10. The LED assembly of claim 1, wherein the electrical terminal is selected from the group consisting of a ring terminal and an open terminal.

11. The LED assembly of claim 1, wherein the LED component is a chip-on-board (COB) component.

12. The LED assembly of claim 1, wherein the fastener includes a nut and a stud, wherein the stud extends from the heatsink, and wherein the nut attaches to the stud.

13. A method for attaching an LED assembly to a heatsink, comprising the steps of:

a. contacting at least one electrical terminal with a corresponding one of an electrical pad on a surface of an LED component; and, b. mechanically attaching the LED component to the heatsink and maintaining the contact between at least one of the electrical terminals and a corresponding one of the electrical pads by passing a fastener through an aperture in the LED component and an aperture in the electrical terminal, wherein the LED component is arranged and configured to electrically connect to the power source.

14. The LED assembly of claim 8 further comprising a bushing configured to insulate the fastener from the electrical terminal.

15. The LED assembly of claim 14, wherein the bushing includes a shoulder configured to substantially align the electrical terminal with the electrical pad.

16. The LED assembly of claim 14, wherein the bushing is sized to cover the LED component.

17. The LED assembly of claim 8 further comprising a plurality of second electrical pads and a plurality of second electrical terminals, wherein at least one of the plurality of second electrical pads is configured for a solder connection with a corresponding one of the second electrical terminals.

18. The LED assembly of claim 8, wherein the aperture is a first aperture and the fastener is a first fastener, and wherein the LED component includes a second aperture formed therethrough, and wherein a second fastener passes through the second aperture to attach the LED component to the heatsink.

19. The LED assembly of claim 8, wherein the LED component is a chip-on-board (COB) component.

20. The LED assembly of claim 8, wherein the fastener includes a nut and a stud, wherein the stud extends from the heatsink, and wherein the nut attaches to the stud.

* * * * *